United States Patent [19]

Thoma et al.

[11] Patent Number: 4,942,819

[45] Date of Patent: Jul. 24, 1990

[54] HOLLOW CHARGE

[76] Inventors: Klaus Thoma, Max-Emanuel-Street 12, 8898 Schrobenhausen; Klaus Lindstädt, Teutonen St. 54, 5300 Bonn 2; Karl Rudolf, Georg-Hitl-St. 8, 8898 Schrobenhausen, all of Fed. Rep. of Germany

[21] Appl. No.: 397,463

[22] Filed: Jun. 30, 1982

[30] Foreign Application Priority Data

Jul. 10, 1981 [DE] Fed. Rep. of Germany ..... 3127280

[51] Int. Cl.[5] ..... F42B 1/024

[52] U.S. Cl. ..... 102/476; 102/307; 102/309; 102/701

[58] Field of Search ..... 102/475, 476, 701, 306, 102/307, 309

[56] References Cited

U.S. PATENT DOCUMENTS

| | | | |
|---|---|---|---|
| 2,809,585 | 10/1957 | Moses | 102/701 |
| 3,027,838 | 4/1962 | Meddick | 102/309 |
| 3,100,445 | 8/1963 | Poulter | 102/701 |
| 3,103,882 | 9/1963 | Gilliland | 102/701 |
| 3,732,818 | 5/1973 | Thomanek | 102/306 |

*Primary Examiner*—Charles T. Jordan
*Assistant Examiner*—Richard W. Wendtland

[57] ABSTRACT

Hollow charge with a jet-forming lining or cover, in particular for producing a channel for a follow-through projectile in take-off runways, roadways or other stationary ground targets. A projectile-forming inert material is located between an initiator point and the jet-forming lining or cover at a distance from the initiator point and jet-forming lining or cover. The size, geometry, thickness and spatial position of the projectile-forming body are adaptable to the respective target characteristics.

7 Claims, 4 Drawing Sheets

HOLLOW CHARGE

The invention concerns a hollow or shaped charge with a lining or cover for forming a jet, in particular for producing a firing channel for a follow-through projectile or shell in take-off runways, roadways or other stationary ground targets.

When a crater is formed in the target by a shaped or hollow charge jet a sump of lining melt or cover melt, respectively, can be observed at the bottom of the crater immediately after the crater is formed. Moreover, a very strong compression in the target material can be noted initially in a layer area, measuring at least a few centimeters, behind the metal sump in question and the compressed region is followed by a relaxation of the target material layer in question at a speed of unknown magnitude.

It must still be noted here in reference to the metal sump that if a follow-through shell or projectile strikes this metal sump it will lead to atomization of the metal melt forming the sump resulting in greater liquid surfaces for strong exothermal oxide, silicate, carbide and decomposition reactions.

The latter is, along with the above-mentioned compression and relaxation phenomena, the reason why such follow-through shells which trail a hollow charge jet through its crater with a speed below a limit value of around 190 m/s according to the order of magnitude, are often ejected from the crater again instead of penetrating further into the interior of the target through its subbase as desired.

The crater base effects described above only occur with follow-through shells whose speeds lie above the indicated limit value. The high accelerations required present great technical problems and make necessary considerable structural reinforcements in the shell embodiments at the expense of the explosive payload.

Therefore, it is the primary object of the present invention to make provision from the start and with simple means in hollow or shaped charges of the type mentioned above for a neutralization of the indicated crater base effects and to do this in a way which readily affords the possibility of a desired performance variations.

In accordance with the present invention a projectile forming inert material body is positioned in the explosive charge of a hollow or shaped charge between the jet-forming lining and an initiator point. The position of the inert material body is determined by the material of the target, and the body forms a following explosive formed projectile.

The measures taken according to the invention can be easily realized. They result in a hollow or shaped charge during whose detonation a shaped projectile formed by the explosive is obtained in addition to the hollow charge jet, which projectile immediately follows the hollow charge jet and, if it hits the target, penetrates forwardly through the crater formed by the jet in the target material into the crater base.

With its energy originating from the hollow charge vapor it is able to neutralize the crater base for a follow-through projectile by means of atomizing the lining melt located there as well as by means of loosening the compressed adjoining target subbase and possibly also provides for a deepening of the crater. Worthy of note in this context is the possibility of optimally adapting the mass and speed of the explosive-formed projectile to the given system conditions via explosive charge position as well as spatial position, form, geometry and material constitution of the inert material body forming the projectile.

Moreover, it is also easily possible with the inert material forming the projectile to exert direct influence on the collapse process of the jet-forming casing or cover and to alter the performance pattern of the hollow charge jet in correspondance with the respective target relations.

It remains to be mentioned that for a follow-through projectile the achieved neutralization of the crater base, among other things, is significant to the extent that the projectile loads are reduced thereby by approximately half. In the construction of such a follow-through projectile this allows appreciable saving of weight to the advantage of a correspondingly higher explosive payload. Moreover, the choice of material becomes less problematic.

The projectile-forming inert material body of the hollow charge according to the invention can be built rigidly into the explosive charge for a special target. Simple alternative measures make it possible to adapt the effect to various targets shortly before firing.

The characteristic features of the invention and their technical advantages result from the following description of embodiment examples in connection with the claims and the schematic drawing. Shown in the form of diagrammatic sketches are:

Figure 1:
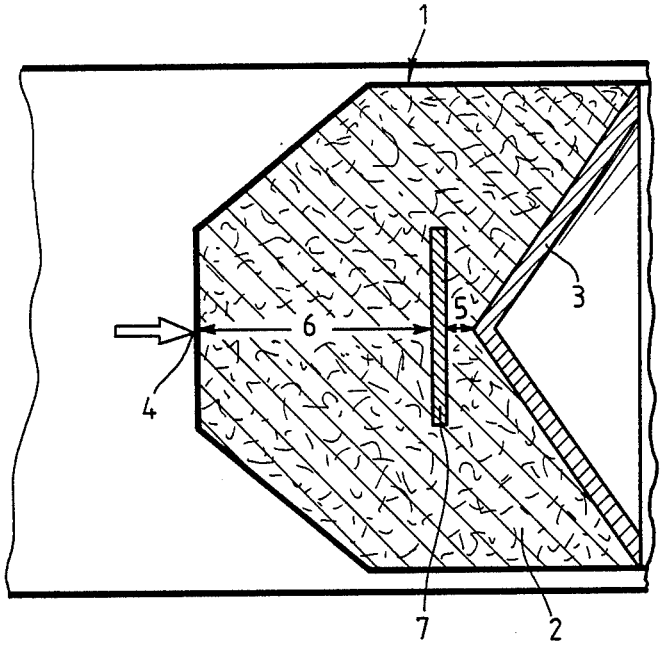
FIG. 1 is a sectional view of a hollow charge with a jet-forming lining and a projectile-forming inert material body.
Figure 2:
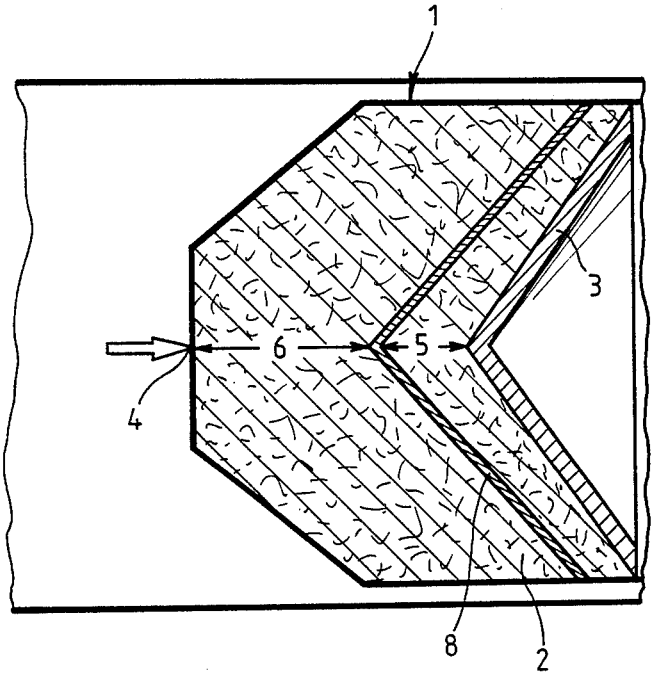
FIGS. 2 through 5 are sectional views of hollow charge embodiments with varied inert material body relative to FIG. 1 and FIGS. 5*a* through 5*e* are sections taken along line V–V in FIG. 5 with the inert material body embodiment in various locations.

A hollow or shaped charge 1 is shown in longitudinal section in FIG. 1. In its explosive charge 2 is a projectile-forming inert material body 7 in coaxial position between jet-forming lining 3 and initiator point 4 at a distance 5 from the lining and a distance 6 from the point. The inert material body in question concerns a rigidly installed disk, which forms a projectile running directly behind the hollow charge jet on its path when the charge is detonated.

In FIGS. 2 to 5 the same reference numerals 1 to 6 are used as in FIG. 1. They differ only from the latter in that another inert material body takes the place of the disk-shaped inert material body 7 for the formation of a an explosive formed projectile trailing the hollow charge jet, which other inert material body is formed, by way of example, in FIG. 2 as a cone 8, in FIG. 3 as a truncated cone 9 and in FIg. 4 as a paraboloid 10.

Figure 3:
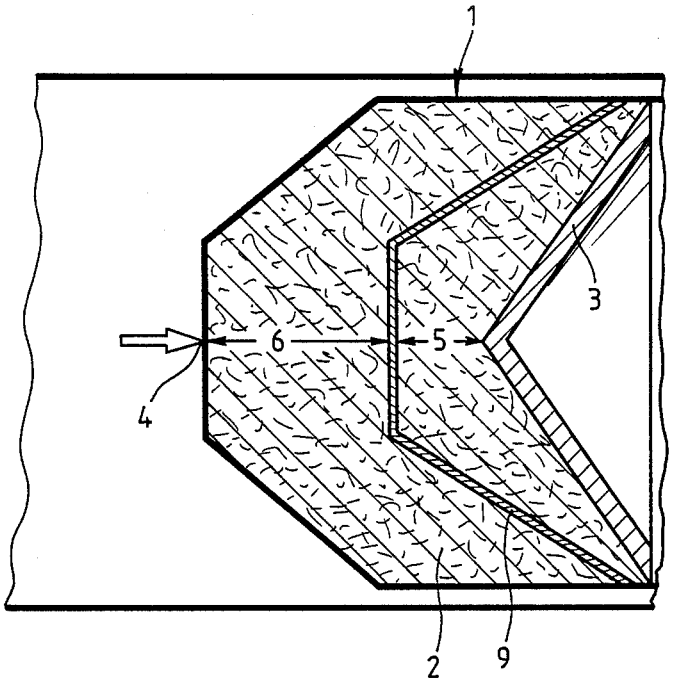
Figure 4:
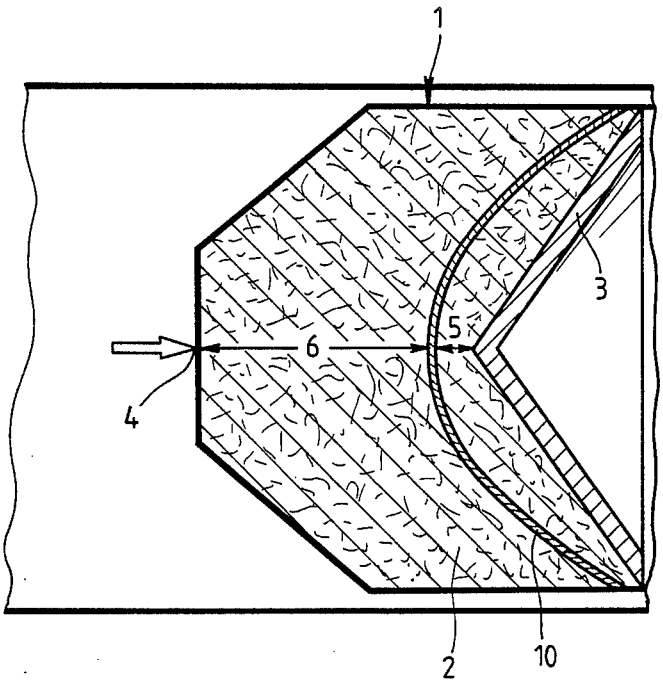
Figure 5:
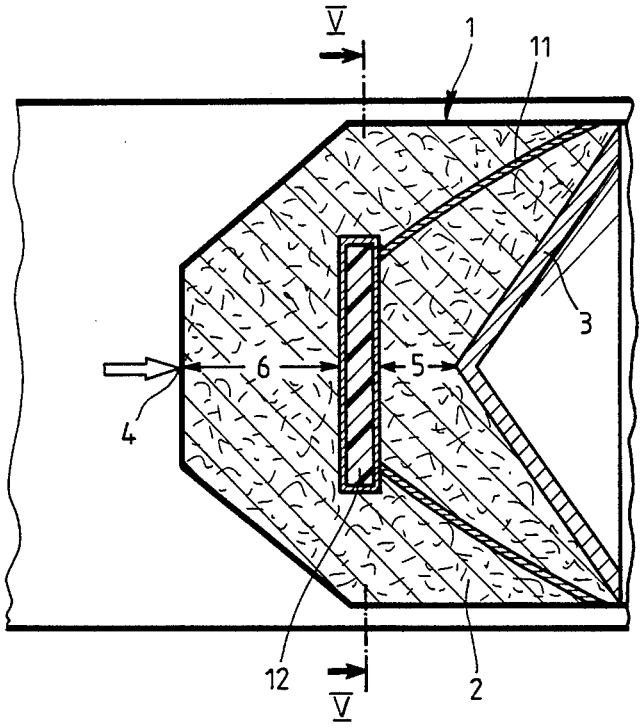
Figure 5A:
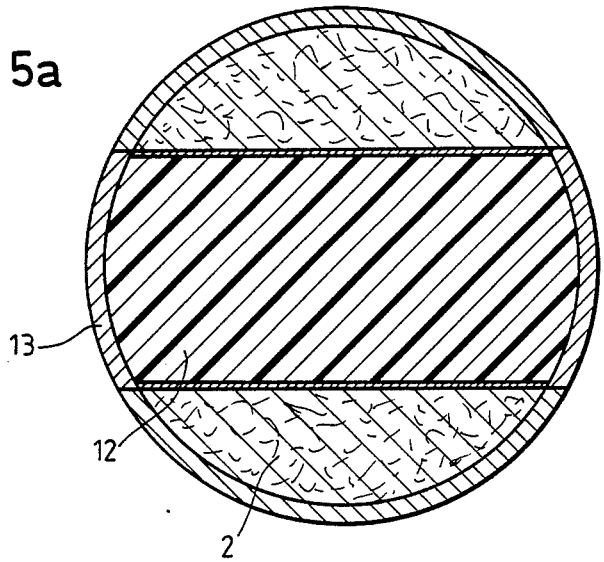
Figure 5B:
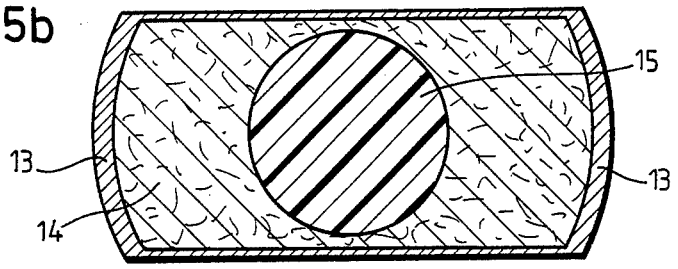
Figure 5C:
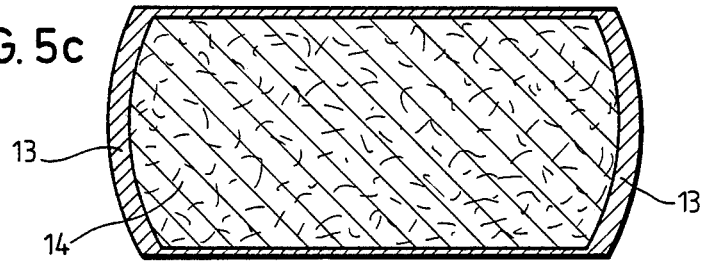

In FIG. 5, analogous to FIG. 3, a conically extending inert material jacket 11 between jet-forming lining 3 and initiator point 4 is fixed in the explosive charge 2. In this embodiment, the jacket 11 contacts a slide-in unit 12 of inert material with shared charge cover 13 (FIG. 5*a*) with its end remote of the cover, which slide-in unit 12 is movable transversely to the charge axis.

In FIGS. 5*b* to 5*e* other slide-in unit variations are shown which have exclusively an explosive 14 (FIG. 5*c*), or an explosive 14 as well as a molded element 15 (FIGS. 5*b* and 5*e*) and 16 (FIG. 5*d*), respectively, of inert material between their shared charge cover parts 13. The central position of the molded element 15 in FIG. 5*b* as well as of the molded element 16 in FIG. 5*d* and the eccentric position of the molded element 15 in FIG. 5*e* should also be noted.

Figure 5D:
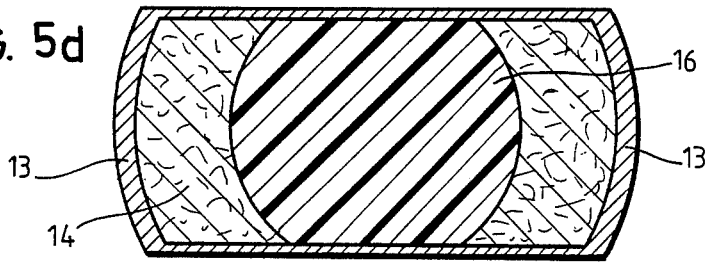
Figure 5E:
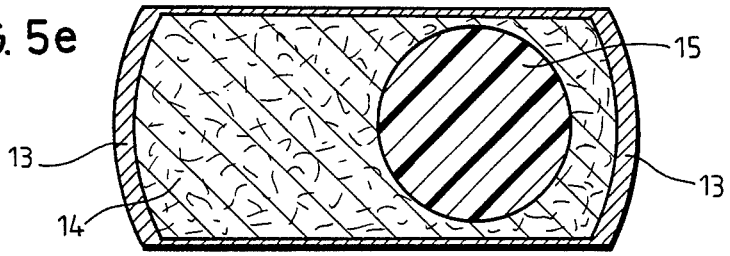

The following statements make clear the extend of the slide-in unit influence on the jet formation out of the hollow charge casing or cover, respectively. Thus, for example, a compact jet can be achieved with a slide-in unit in the embodiment according to FIG. 5*b*. A standard atomizing hollow charge jet is obtained in the slide-in unit formed according to FIG. 5*c*. Where a slide-in unit corresponding to FIG. 5*d* is employed a strong atomization is effected only in one part of the hollow charge jet. On the other hand, a slide-in unit version, as derived from FIG. 5*e*, leads to a strong atomization of the entire hollow charge jet resulting in a cutting action or, so to speak, a large-surface action.

We claim:

1. Shaped explosive charge having a leading end facing in the firing direction and a trailing end, an inverted conically shaped jet-forming lining extending from the leading end toward the trailing end, an explosive charge extending from said jet-forming lining toward the trailing end, said lining being arranged when said explosive charge is ignited to produce a channel for a follow-through projectile for use against take-off runways, roadways or other stationary ground targets, wherein the improvement comprises an initiator point (4) located at the trailing end of said explosive charge, a projectile-forming inert material body (7, 8, 9, 10, 11, 12, 15, 16) is located in said explosive charge between and spaced form said initiator point and said jet-forming lining, and the size, geometry, and location of said body is adaptable to the characteristic of the target against which the shaped charge is directed so that the inert material body forms an explosive-formed projectile when said explosive charge is ignited for neutralizing crater base effects caused by the jet-forming lining and improving the effectiveness of the follow-through projectile.

2. Shaped charge according to claim 1, wherein said projectile-forming inert material body (11, 12, 15, 16) is located in said explosive charge (2) so as to be selectively positioned between said initiator point and jet-forming lining.

3. Shaped charge, as set forth in claim 2, wherein said projectile forming inert material body comprises a shared charge cover (13), and a replaceable slide-in unit (12) located within said cover.

4. Shaped charge, as set forth in claim 2, wherein said explosive charge (2) includes a shared charge cover (13) and a replaceable charge section (14) located within said shared charge cover and said shared charge cover and charge section being located in the region of said inert material body.

5. Shaped charge according to claim 4, wherein said replaceable charge section (14) is arranged centrally within said explosive charge (2).

6. Shaped charge, as set forth in claim 4, wherein said replaceable charge section (14) is located eccentrically within said explosive charge (2).

7. Shaped charge, as set forth in claim 1, wherein said inert material body is located closer to said lining than to said initiator point.

* * * * *